US005832909A

United States Patent [19]

Grant et al.

[11] Patent Number: 5,832,909

[45] Date of Patent: Nov. 10, 1998

[54] BALL PITCHING MACHINE

[75] Inventors: Eugene J. P. Grant, Reno; Todd Trapp, Carson City, both of Nev.; Ian Fettes, Newport Beach, Calif.

[73] Assignee: Athletic Training Equipment Company, Sparks, Nev.

[21] Appl. No.: 733,126

[22] Filed: Oct. 17, 1996

[51] Int. Cl.[6] ..... F41B 4/00

[52] U.S. Cl. ..... 124/6

[58] Field of Search ..... 124/6, 78

[56] References Cited

U.S. PATENT DOCUMENTS

| | | | |
|---|---|---|---|
| Re. 30,703 | 8/1981 | Paulson et al. | 124/81 X |
| 4,197,827 | 4/1980 | Smith | 124/78 |
| 4,323,047 | 4/1982 | McIntosh et al. | 124/81 X |
| 4,442,823 | 4/1984 | Floyd et al. | 124/78 |
| 4,632,088 | 12/1986 | Bruce | 124/78 |
| 4,705,014 | 11/1987 | Kahelin | 124/6 X |
| 4,712,534 | 12/1987 | Nozato | 124/78 |
| 4,760,835 | 8/1988 | Paulson et al. | 124/78 |
| 5,012,790 | 5/1991 | Bates | 124/6 X |
| 5,127,390 | 7/1992 | Paulson | 124/80 |
| 5,437,261 | 8/1995 | Paulson et al. | 124/78 |

OTHER PUBLICATIONS

Advertisement—Casey Pitching Machine.
Advertisement—Casey II Pitching Machine.

*Primary Examiner*—John A. Ricci
*Attorney, Agent, or Firm*—James E. Brunton

[57] ABSTRACT

A ball pitching machine which uniquely embodies a single, specially configured ball engaging wheel which is rotatably mounted within a wheel housing that, along with a ball receiving barrel, is easily rotatable through an angle of 270 degrees. With this novel construction, the device can be used to accurately pitch a variety of fast balls, curve balls and sliders. The ball engaging wheel of the pitching head is of a novel vaned construction so that as the wheel is rotated within its housing a negative pressure will be generated within the housing and within the ball receiving barrel which is associated therewith so that the ball will be sucked into the barrel and into positive driving engagement with the periphery of the rotating wheel.

19 Claims, 7 Drawing Sheets

7
28b
27
60
56
58
40
25
34
60
28
30
36
34
B
25
48
28a
40
32
36
52
37
25
12
32
26a
43
78a
24
26b
84
14
80
78
18
22
18a
78b
76
23
7
31b
31
31a
26b
66
28a
82
68
26
26a
28
70
80
14
18

BALL PITCHING MACHINE

BACKGROUND OF THE INVENTION

Field of the Invention

The present invention relates generally to machines for propelling balls. More particularly, the invention concerns a machine for pitching a baseball or softball in a predetermined direction.

DISCUSSION OF THE INVENTION

Various types of baseball pitching machines have been suggested in the past. Many of these prior art machines employ a pair of oppositely rotating pneumatic tires between which a baseball is received for propelling or pitching the baseball in a trajectory tangential to the tire peripheries. Typically, the pneumatic tires are closely enough spaced so that as they receive the baseball therebetween they will compress slightly and propel the baseball at a velocity determined by the speed of the rotation of the tires. Exemplary of this type of machine is that manufactured and sold by Juggs, Inc. of Tualitin, Oreg.

A variation of the standard prior art pneumatic tire type pitching machine is disclosed in U.S. Pat. No. 4,442,823 issued to Floyd et al. This latter device includes three rotatable wheels having planes and centers of rotation, the centers of rotation being coplanar and disposed in spaced-apart locations on the plane. The wheels are disposed about a feeding point so as to act upon a fed ball and can be oriented at a plurality of angles with respect to each other so as to effect various spin vectors with respect to a normal straight line trajectory axis. The Floyd et al device also includes an integrated machine computer for computing the individual speeds of rotation of the wheels and the individual rifle angles for orienting the wheels.

In addition to baseball type pitching machines, a number of different types of tennis ball propelling machines have also been proposed. These machines, like the baseball pitching machines, also generally embody a pair of oppositely rotating ball engaging wheels and typically rely on the compressibility of the tennis ball to propel the ball from the machine.

One of the most successful prior art pitching machines that has been developed and commercialized in the past is that described in U.S. Pat. No. 4,197,827 issued to Tommy L. Smith. This machine includes a pair of adjacent ball engaging wheels each provided with a groove or concave surface formed in a body of an elastomeric material. As the baseball is received between the grooved wheels, the groove edges are laterally distorted in a manner to grip the baseball securely on opposite sides thereof and pitch the baseball accurately in a predetermined direction. Vertical adjustment can be made to the pitching head of the machine so as to pitch the ball either in a horizontal direction or in an angularly upward direction.

Another highly successful prior art pitching machine, which embodies a single wheel rather than dual, oppositely rotating wheels, has been manufactured and sold by The Athletic Training Equipment Company of Sparks, Nev. under the name and style "CASEY II". This latter machine includes a solid polyurethane covered wheel which cooperates with a proximately disposed grooved pitch pad to propel the ball from the machine.

Other types of prior art ball propelling machines are those described in U.S. Pat. No. 4,760,835 issued to Paulson et al; U.S. Pat. No. 4,713,534 issued to Nozato; and U.S. Pat. No. 4,633,083 issued to Bruce. This latter patent to Bruce discloses a ball throwing apparatus which has two opposed drive wheels, one on each side of an open-ended barrel. The peripheries of both drive wheels extend into the barrel in opposing fashion, the wheels being slightly offset so that the secondary periphery frictionally engages the ball before the first periphery does. This directs the ball initially on a path divergent from the barrel axis.

The present invention comprises a significant improvement over the prior art machines and, among other novel features, includes a uniquely mounted pitching head that can be rotated relative to an adjustable tripod support through an arc of 270 degrees. This rotatable pitching head enables the machine to accurately simulate a number of pitches, including a straight fastball, right- and left-handed sliders and a variety of curve balls. The improved device also includes a novel ball engaging wheel which, upon being rotated, draws cooling air into the pitching head thereby efficiently cooling the motor, the bearings and the speed control/electronics of the machine. Additionally, due to the novel construction of the wheel, rotation of the wheel creates a pressure differential within the barrel which automatically pulls the fed balls from the entry point of the pitching head into frictional engagement with the periphery of the rotating wheel. This feature makes the device considerably easier and safer to use.

Another novel feature of the improved pitching machine of the present invention is the provision of a novel, readily removable insert that selectively modifies the barrel of the machine so that the machine can accommodate numerous ball sizes without having to change the barrel of the machine.

SUMMARY OF THE INVENTION

The present invention relates to a ball pitching machine which embodies a single, specially configured ball engaging wheel which is rotatably mounted within a wheel housing that, along with a ball receiving barrel, is easily rotatable through an angle of about 270 degrees. With this novel construction, the device can be used to accurately pitch a variety of fast balls, curve balls and sliders.

It is an objective of the invention to provide a pitching machine of the aforementioned character which is of simple construction embodying a minimum number of moving parts, is easy to assemble and is compact, lightweight and easy to transport.

Another object of the invention is to provide a pitching machine of the character described, in which the pitching head of the machine is rotatably mounted on a novel support which, in turn, is mounted on a lightweight, highly stable tripod assembly. With this construction, the ball receiving barrel of the machine can easily be rotated in a generally horizontal plane through an angle of 360 degrees.

Another object of the invention is to provide a pitching machine as described in the preceding paragraphs in which the trajectory of the ball can readily be adjusted.

It is still another object of the invention to provide a ball pitching machine of the type described, in which the ball engaging wheel of the pitching head is of a novel vaned construction so that as the wheel is rotated within its housing, a negative pressure will be generated within the housing and within the ball receiving barrel which is associated therewith so that the ball will be sucked into the barrel and into positive driving engagement with the periphery of the rotating wheel.

Yet another object of the invention is to provide a novel pitching machine of the character described which includes readily removable pinch pads of different sizes which cooperate with the rotating wheel to propel balls of various sizes from the machine at various rates of speed and at various trajectories.

DESCRIPTION OF THE INVENTION

Figure 2:
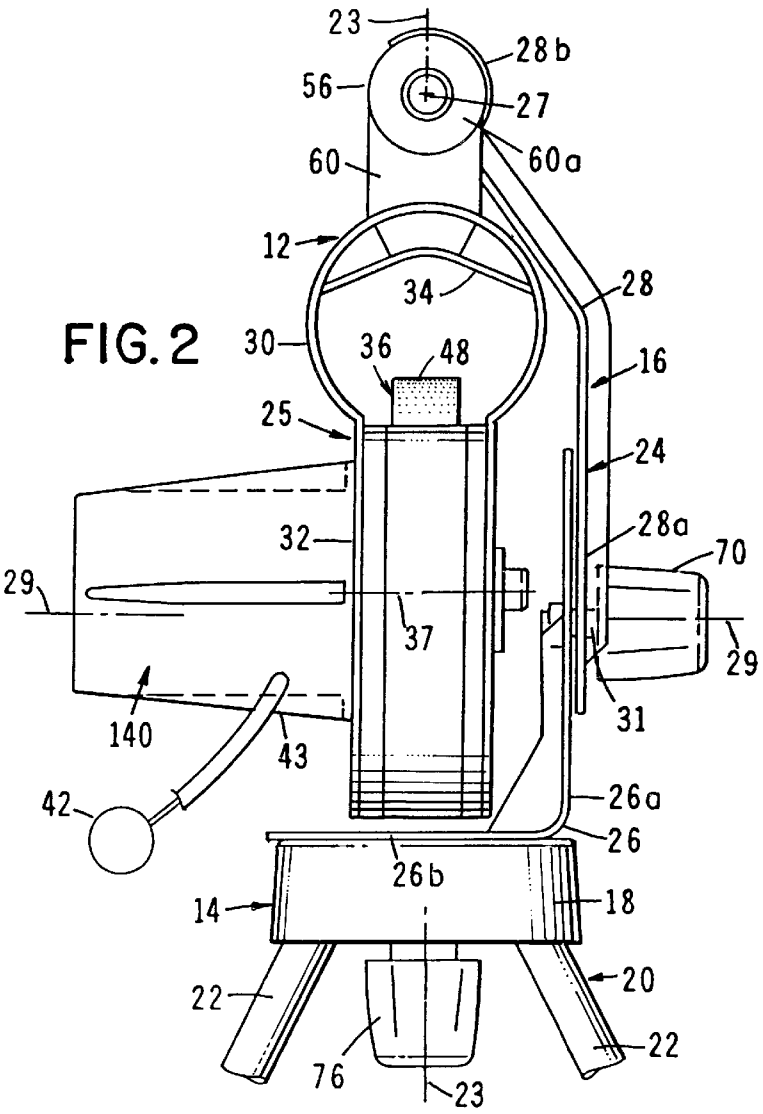
FIG. 2 is an enlarged, front-elevational view of the upper portion of the machine shown in FIG. 1.
Figure 1:
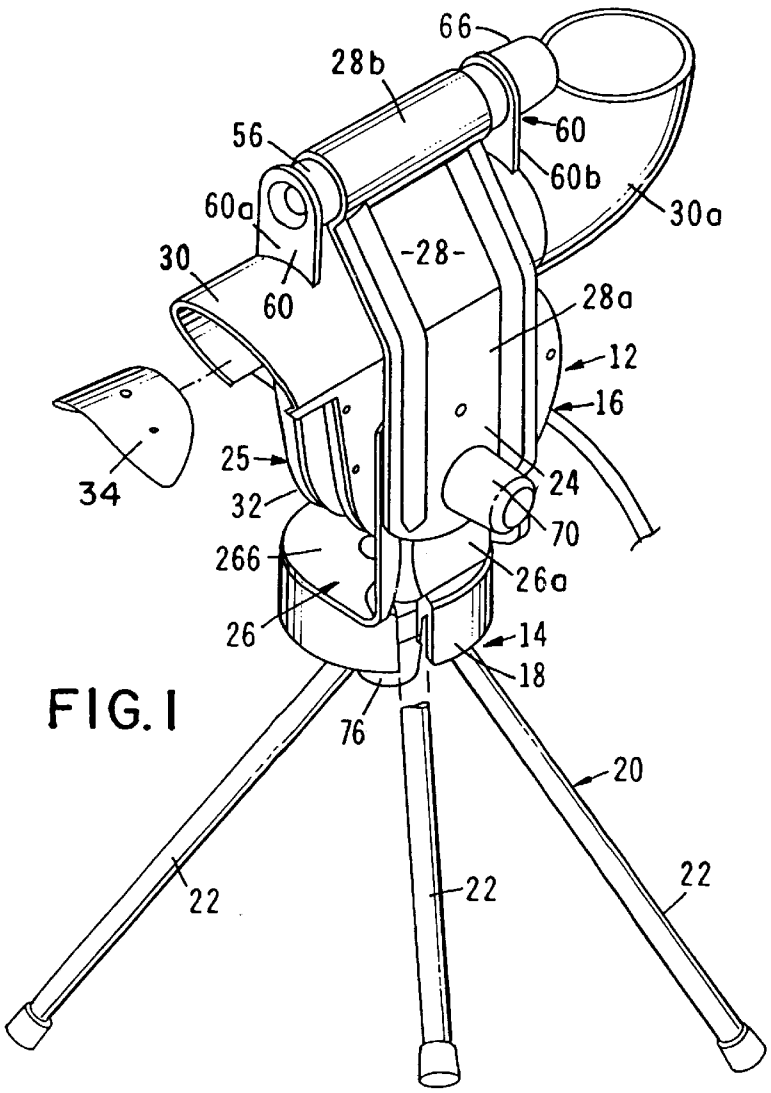
FIG. 1 is a generally perspective, exploded view of one form of the pitching machine of the invention.
Figure 3:
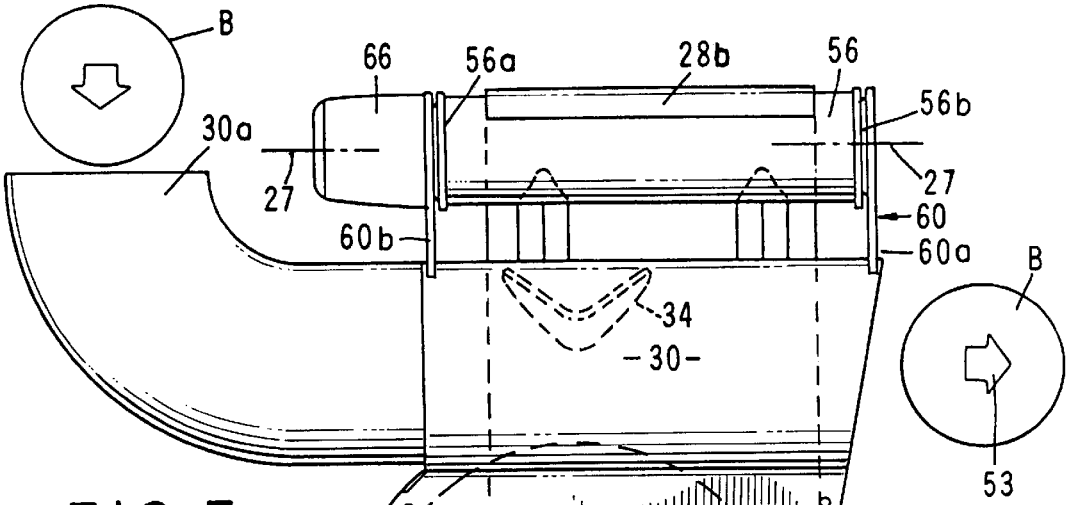
FIG. 3 is an enlarged, left-hand, side-elevational view of the upper portion of the machine shown in FIG. 1.

Referring to the drawings and particularly to FIGS. 1, 2, and 3, one form of the ball pitching machine of the present invention is there illustrated and generally designated by the numeral 12. The machine here comprises a base assembly 14 and a pitching head assembly 16. Base assembly 14 includes a hub assembly 18 and a tripod assembly 20 which is connected to the hub assembly and comprises three downwardly and outwardly extending support legs 22.

Pitching head assembly 16, which is rotatably mounted on the base assembly for 360 degree rotation about a substantially vertical first axis 23 (FIG. 2), includes a support bracket assembly 24 and a housing assembly 25 connected thereto. In the manner presently to be described, housing assembly 25 is pivotally movable through an angle of approximately 270 degrees about a second pivot axis 27 (FIGS. 2 and 3).

Figure 5:
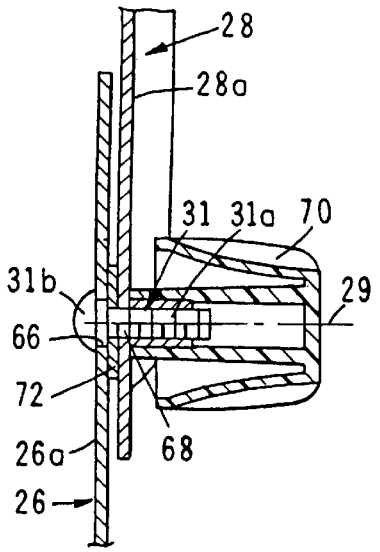
FIG. 5 is a fragmentary, cross-sectional view taken along lines 5—5 of FIG. 4.

Support bracket 24 is made up of first and second formed components 26 and 28 respectively which are pivotally interconnected in the manner shown in FIG. 5 for rotation about a third axis 29 defined by the axis of a threaded connector 31 (FIG. 2). Components 26 and 28 are preferably formed from molded or cast metal. As indicated in FIGS. 2 and 5, first bracket component 26 is made up of a generally vertically extending leg 26*a* and a generally planar, horizontally extending leg 26*b* which is rotatably connected to the base assembly in the manner shown in FIG. 6 for rotation about axis 23. Second component 28 of support bracket 24 also includes first and second end portions 28*a* and 28*b* having the general configuration best seen in FIGS. 1 and 2. More particularly, first end portion 28*a* of bracket component 28 is connected to leg 26*a* of bracket component 26 in the manner shown in FIGS. 5 and 8, while second end portion 28*b* terminates in a generally arcuate or "C" shaped portion of the character shown in FIG. 2 which circumscribes second axis 27.

Housing assembly 25 is made up of a barrel portion 30 and a wheel housing portion 32. As indicated in FIGS. 1 and 2, a novel pinch pad 34 is removably mounted within barrel portion 30 and a uniquely configured, single ball-engaging wheel 36 is rotatably mounted within wheel housing portion 32. It is to be understood that, while the barrel portion 30 is shown in the drawing as being round, it can also be of other shapes. The ball-engaging wheel 36 is rotatable about a fourth axis 37 by motor means here provided in the form of a variable speed electric motor 40 which is carried externally of housing portion 32 in the manner shown in FIG. 2. Electric motor 40 is of a character well known to those skilled in the art and is readily commercially available from sources such as Leeson Electric Motors of Grafton, Wis. The speed of rotation of the motor is controlled by a conventional speed control unit schematically shown in FIG. 2 and identified by the numeral 42. Speed control unit 42 is also of a character well known to those skilled in the art and can be mounted on the motor housing 43 or at any other suitable location depending upon the desires of the end user of the machine.

Figure 10:
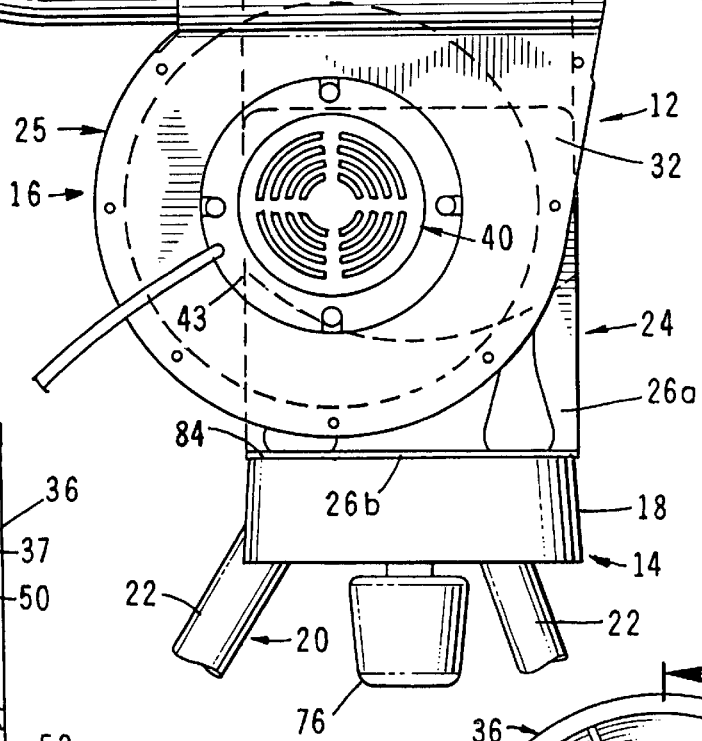
FIG. 10 is an enlarged, cross-sectional view of the wheel taken along lines 10—10 of FIG. 9 and illustrating the novel vaned construction of the wheel.
Figure 10:
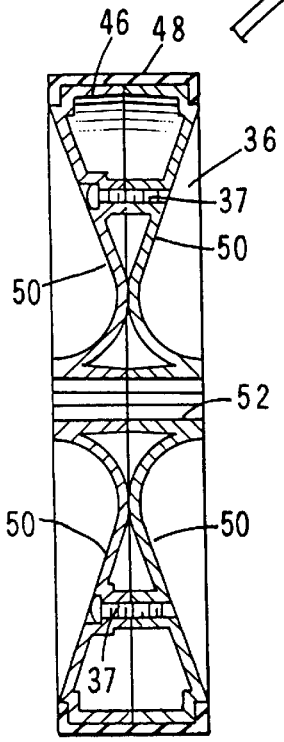
Figure 9:
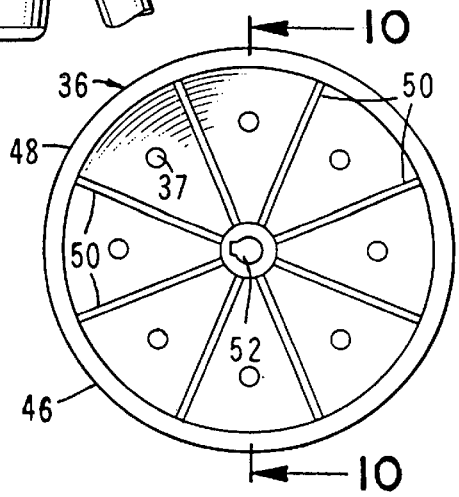
FIG. 9 is a side-elevational view of the rotating wheel that propels the ball.

Referring now to FIG. 9 and 10, the ball-engaging wheel of the present invention can be seen to be of a unique construction comprising an outer peripheral portion or rim 46 over which a suitable elastomer such as artificial rubber is injection molded to form a yieldably deformable peripheral ball engaging surface 48. Wheel 36 is also provided with a plurality of circumferentially spaced, radially extending, uniquely configured vanes 50 for causing a negative pressure to be generated within barrel portion 30 of housing assembly 25 as the ball engaging wheel is controllably rotated within wheel housing portion 25. Each of the vanes 50 is uniquely shaped and extends radially outwardly from the axle receiving portion 52 of the wheel in the manner best seen in FIG. 10. With this novel construction, when the ball to be pitched is inserted into the upwardly curved end portion 30*a* of barrel 30 in the manner illustrated in FIG. 3, the ball will be urged inwardly of the barrel portion and then forwardly in a direction toward the ball engaging pinch pad 34. When the ball reaches the pinch pad 34, it will be pinched between the pinch pad and the resiliently deformable peripheral portion 48 of the ball engaging wheel causing the ball to be propelled rapidly outwardly of the barrel portion 30 with an overspin and in the direction shown by the arrow 53 in FIG. 3. As indicated in FIG. 10, wheel 36 can be constructed in two halves for ease of manufacture with the two halves being connected by threaded connectors 37.

Figures 6, 8:
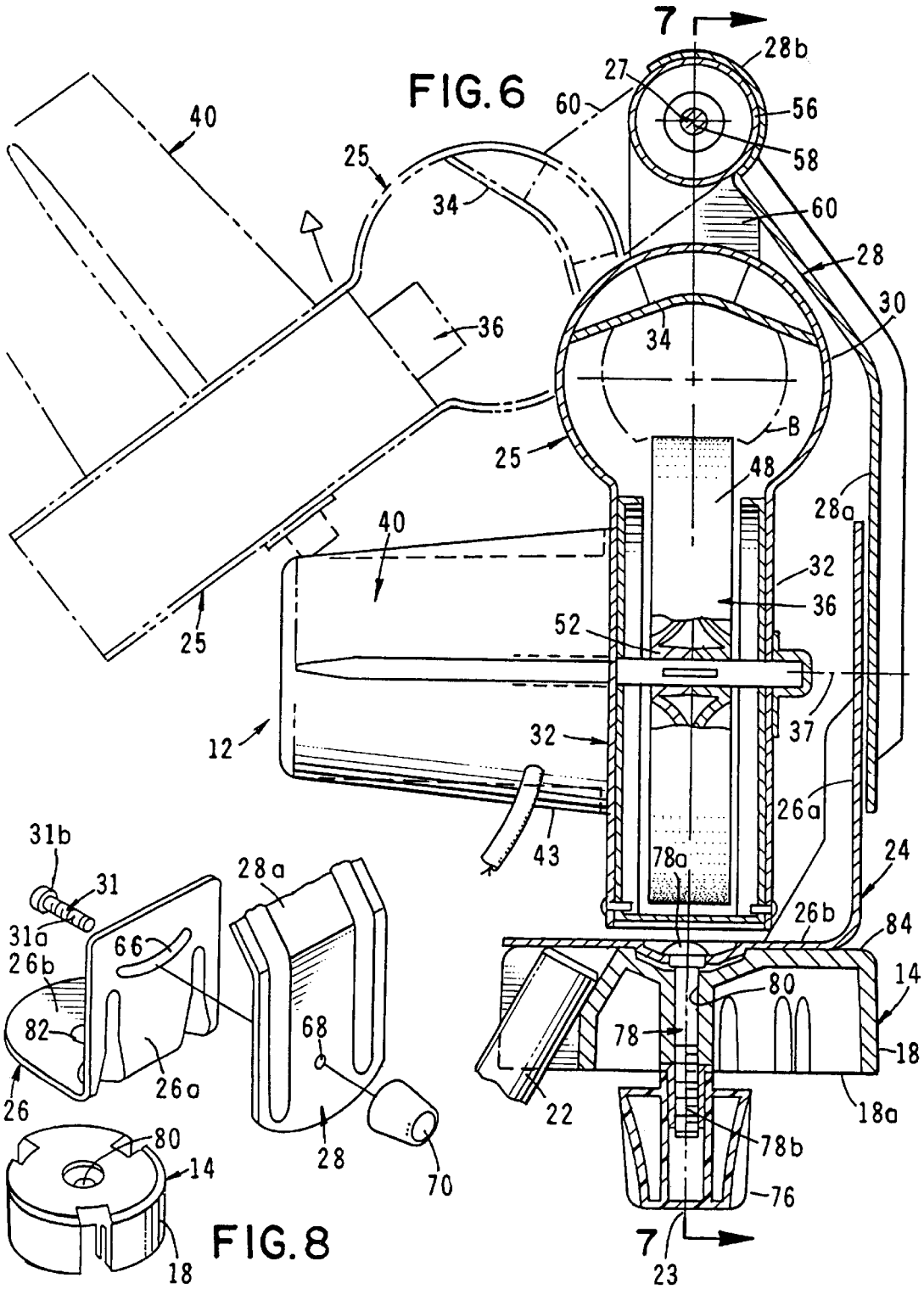
FIG. 6 is an enlarged, cross-sectional view taken along lines 6—6 of FIG. 4.
FIG. 8 is a fragmentary, generally perspective exploded view of the trajectory adjustment and pitching head supporting base subassemblies of the device.
Figure 7:
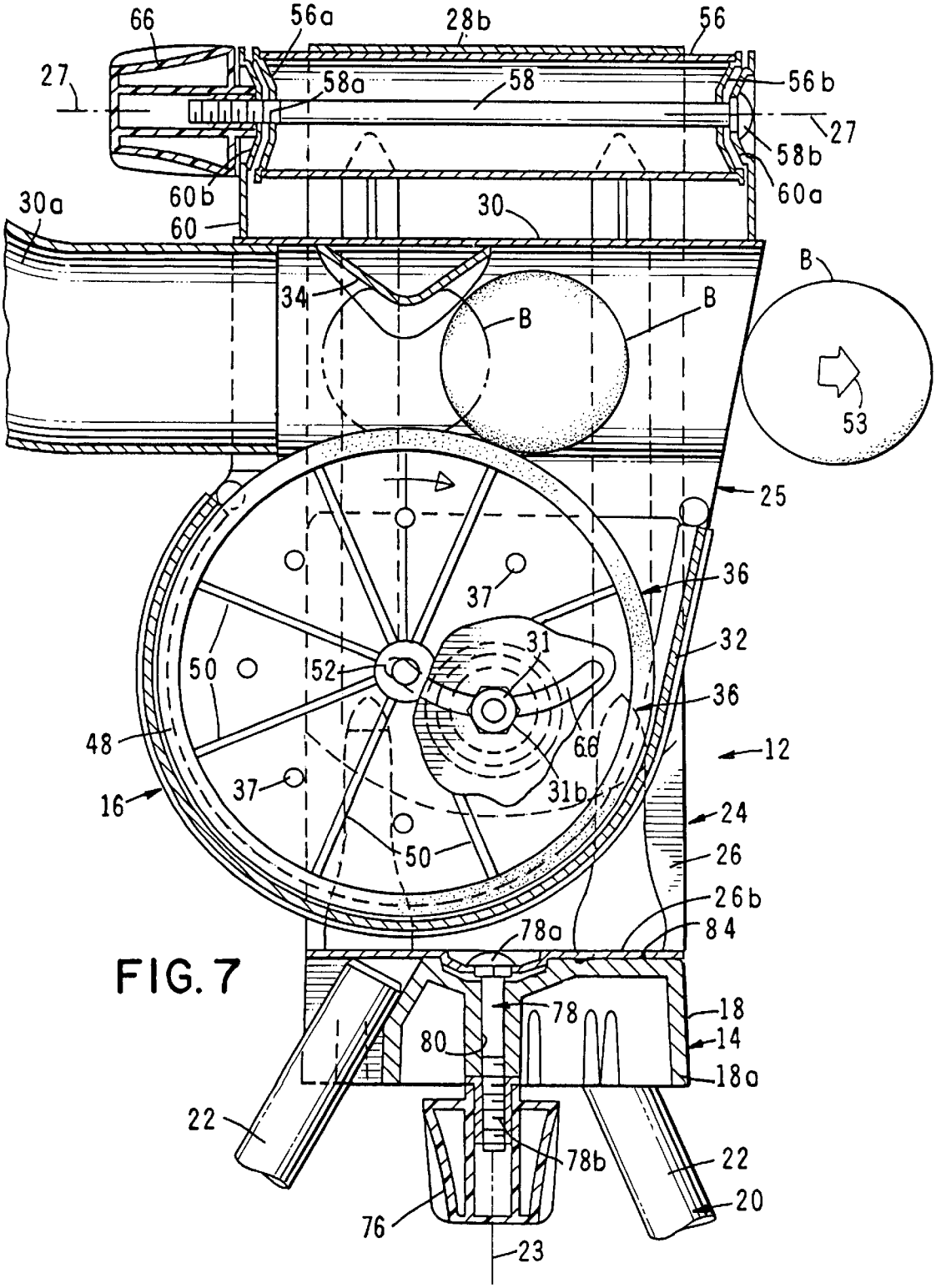
FIG. 7 is a cross-sectional view taken along lines 7—7 of FIG. 6 showing in phantom lines the arcuate adjustment of the pitching head about an axis spaced apart from the axis of the ball receiving barrel.
Figure 12:
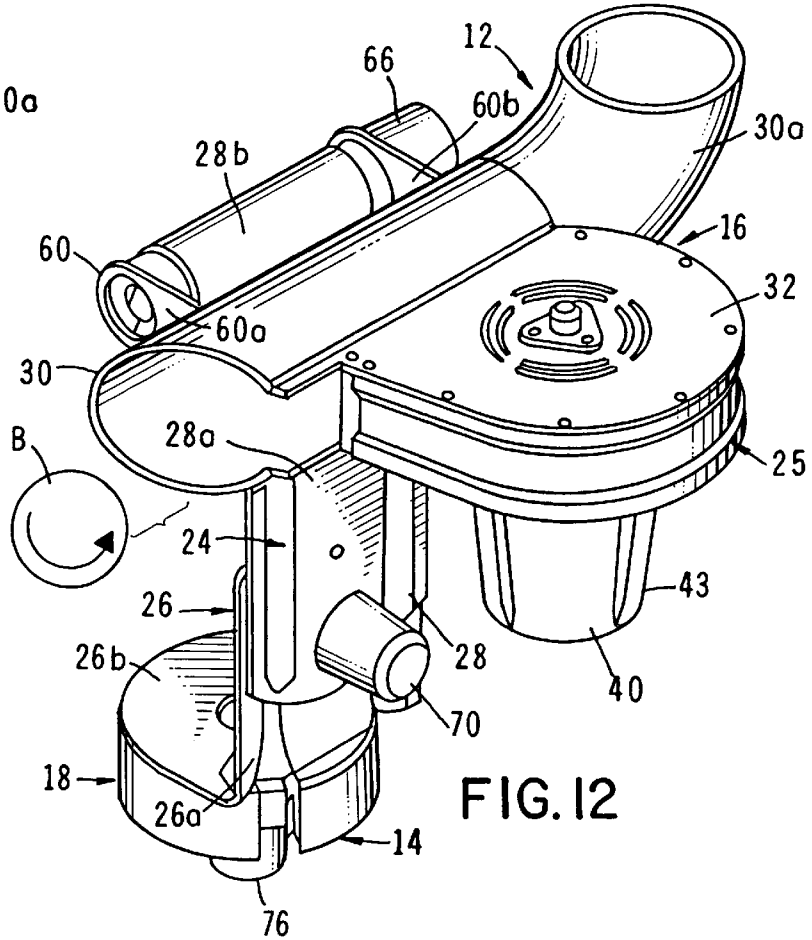
FIG. 12 is a generally perspective view similar to FIG. 11, but showing rotation of the pitching head through an angle of 270 degrees from the position shown in FIG. 1.
Figure 11:
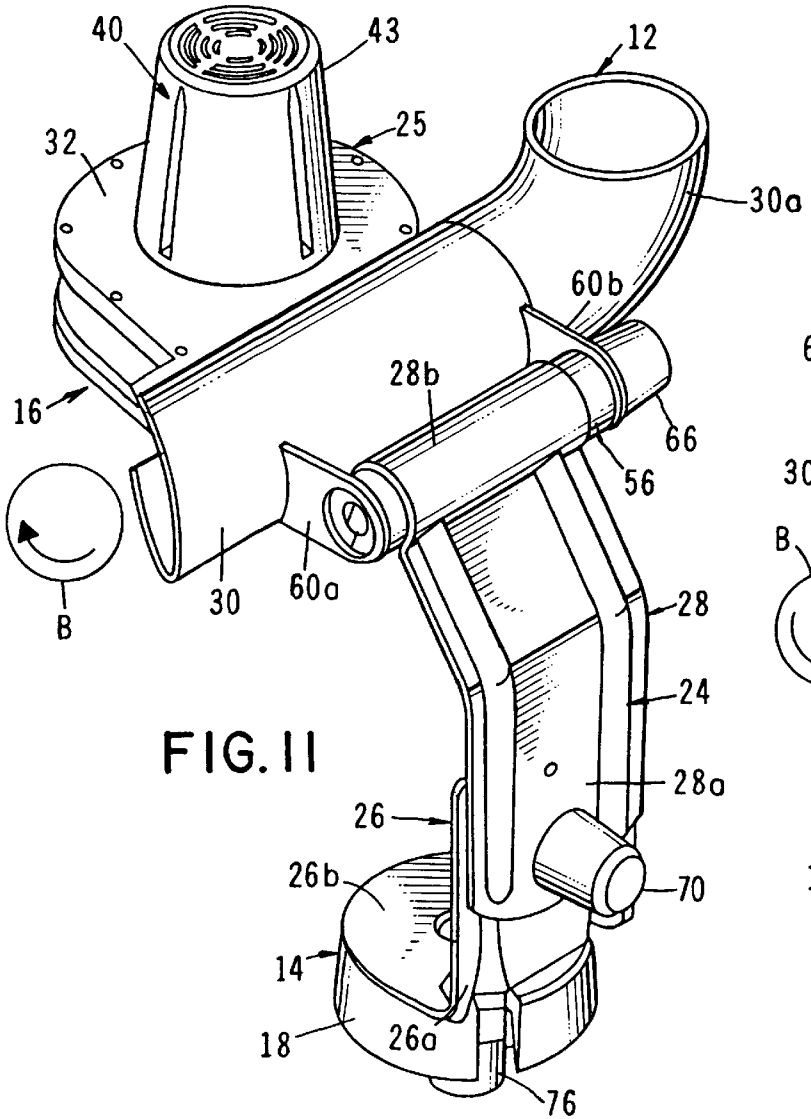
FIG. 11 is a generally perspective view of the pitching head of the apparatus as it appears when rotated 90 degrees from the position shown in FIG. 1.

Turning particularly to FIGS. 6, 11, and 12, a highly novel feature of the pitching machine of the present invention is there illustrated. More particularly, unlike the prior art machines, the entire housing assembly 25 of the present machine can be expeditiously rotated about second axis 27 through an angle of approximately 270 degrees from the first position shown by the solid lines in FIG. 6 to the second position shown in FIG. 12. In a manner presently to be described, the housing assembly can be locked in any selected location between the first and second position shown in FIG. 6 and 12 as, for example, in the 90 degree rotational position shown in FIG. 11. To accomplish this rotational movement, housing assembly 25 further includes a hollow cylinder 56 which, as shown in FIGS. 2 and 6, is closely receivable within arcuate shaped end portion 28*b* of bracket component 28. As illustrated in FIG. 7, the longitudinal axis of cylinder 56 is aligned with second axis 27 as is the longitudinal axis of an axle member 58 which extends the entire length of hollow cylinder 56. It is to be noted that hollow cylinder 56 is provided with first and second apertured end walls 56*a* and 56*b* through which axle 58 extends in the manner shown in FIG. 7. Axle 58 also extends through spaced-apart apertured walls 60*a* and 60*b* of a support bracket 60. Walls 60*a* and 60*b* of bracket 60 are connected to and extend outwardly from the outer surface of barrel portion 30 in the manner illustrated in FIG. 7. With this construction, the housing assembly, which includes support bracket 60, is rotatable about axle 58 in the manner illustrated by the phantom lines of FIG. 6.

To enable housing assembly 25 to be locked in any position, suitable locking means are provided. These locking means here comprise a locking knob 66 which is threadably connected to the threaded end portion 58*a* of axle 58 (FIG. 7). Since the head portion 58*b* of axle 58 engages the exterior surface of apertured wall 60*a*, a tightening rotation of knob 66 will cause arms 60*a* and 60*b* of bracket 60 to be drawn into frictional engagement with walls 56*a* and 56*b* of hollow cylinder assembly 58 in a manner to lock the cylinder against any further rotation about the second axis 27.

To lock the pivotally connected support bracket components 26 and 28 against rotation relative to one another about axis 29, a second locking means is provided. As best seen by referring to FIGS. 5 and 8, this second locking means comprises the previously identified connector 31 which passes through an arcuate slot 66 provided in portion 26*a* of component 26 and also through an aperture 68 provided in portion 28*a* of bracket component 28 (FIG. 8). Threadably mateable with the threaded end portion 31*a* of connector 31 is a tightening knob 70. When knob 70 is rotated in a tightening direction, head portion 31*b* of threaded connector 31 will engage the external surface of portion 26*a* of bracket component 26 so as to urge bracket components 26 and 28 into frictional locking engagement with an immediate spacer washer 72 (FIG. 5). By referring also to FIG. 4, it can be seen that by rotating knob 70 in a loosening direction, bracket component 28 can be pivoted relative to bracket component 26 in the manner indicated by the phantom lines in FIG. 4 so as to raise the trajectory of the propelled ball "B". In this way the machine can be used to move the ball up and down within the strike zone or alternatively can be used to throw deep line drives and fly balls. By pivoting component 28 downwardly, the machine can be used to throw grounders for defensive drills including catcher blocking drills.

To change the direction of flight of the pitched ball, portion 26*b* of bracket component 26 can be rotated relative to the base assembly by loosening knob 76 of a third locking means which functions to lock bracket component 26 against rotation relative to hub assembly 18 (FIG. 7). This third locking means also includes a threaded connector 78 having a head portion 78*a* and a threaded shank portion 78*b* which threadably receives a tightening knob 76. As shown in FIG. 7, connector 78 extends through a central bore 80 provided in hub 18*a* of hub assembly 18 with head 78 engaging the upper surface of portion 26*b* (see also FIGS. 6 and 8). With this construction, a tightening rotation of knob 76 will draw portion 26*b* of bracket component 26 into secure engagement with the upper surface 84 of hub 18*a* so as to prevent further rotation of the pitching head assembly about axis 23.

In using the pitching machine of the present invention, with the machine configured in the manner shown in FIGS. 1, 3, and 7, as the ball "B" is inserted into up-turned end 30*a* of barrel 30, it will be sucked inwardly of the barrel as a result of the venturi effect generated by the curved vanes 50 provided on ball-engaging wheel 36. As the ball is urged forwardly of the barrel portion, it will move into pinching engagement with pinch pad 34 and the resiliently deformable outer periphery 48 of wheel 36 in the manner indicated by the dotted lines in FIG. 7. As the ball passes between pinch pad 34 and rotating ball-engaging wheel 36, it will be propelled rapidly forwardly with an overspin in the direction shown by the arrow 53 in FIGS. 3 and 7. If it desired to pitch balls of differing diameters, pinch pad 34 can be readily removed from barrel portion 30 in the manner indicated in FIG. 1 and replaced with a pinch pad of an appropriate size. For example, if a ball of a diameter of a standard baseball is being pitched, a pinch pad which extends further into barrel 30 will be selected. A shorter pinch pad will, of course, be selected for use with a ball having a diameter approximating a diameter of a conventional softball. It is to be understood that various types and sizes of balls can be used with the machine including elastomeric balls, hollow plastic balls and the like. Hollow plastic balls can be used for fun and recreational games to pitch exaggerated risers and curves.

Figure 4:
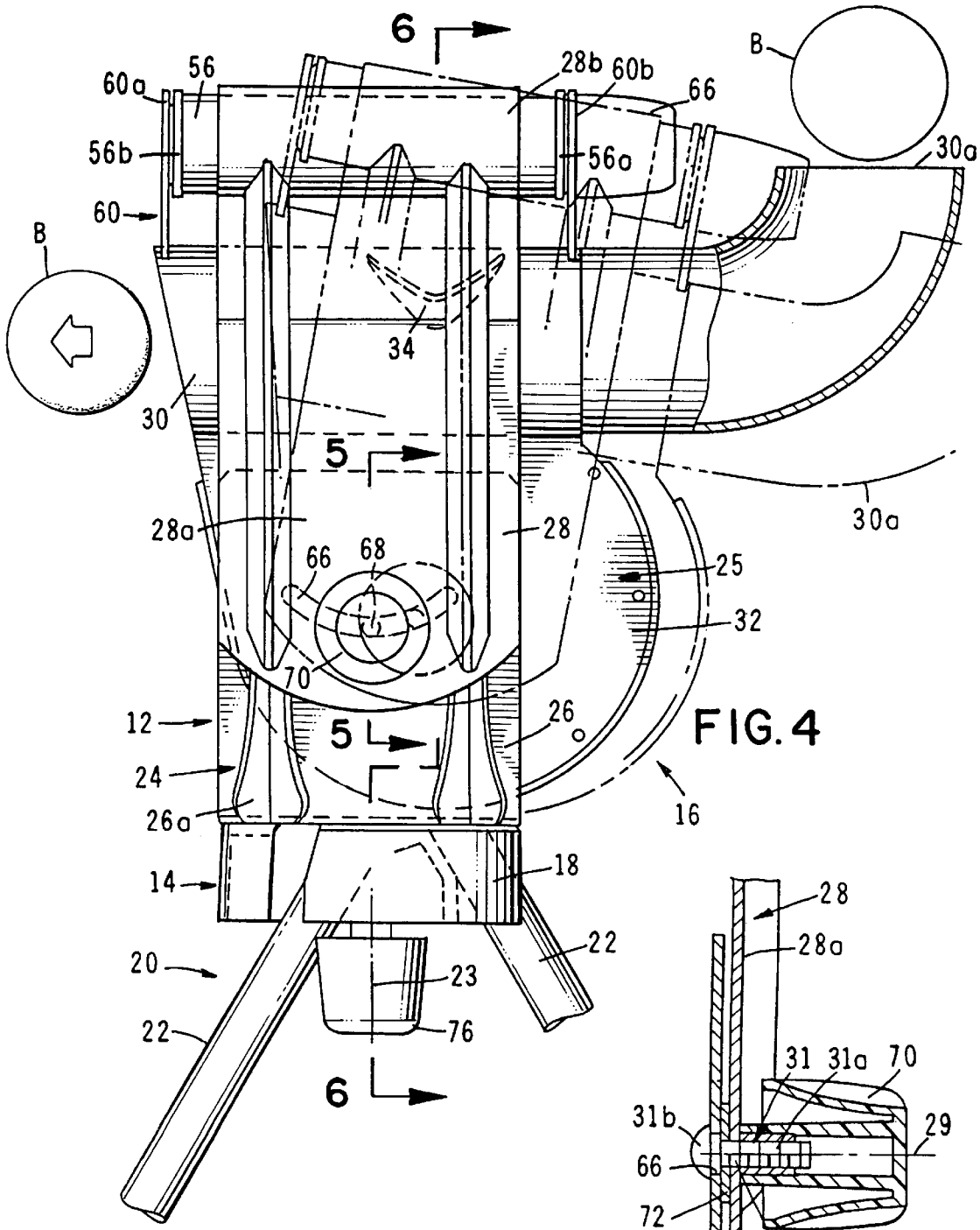
FIG. 4 is an enlarged, right-hand, side-elevational view of the upper portion of the pitching machine showing in phantom lines the manner of adjustment of the device to vary the trajectory of the ball.

As previously mentioned, the trajectory of the ball within the strike zone can be raised and lowered by loosening knob 70 and appropriately adjusting support bracket component 28 upwardly or downwardly relative to the bracket component 26 in the manner indicated in FIG. 4. In using the machine, as the ball passes between ball-engaging wheel 36 and pinch pad 34 a spin will be imparted to the ball, the direction of which is governed by the direction of rotation wheel 36. The rate of spin and, accordingly, the flight characteristics of the ball can be controlled by regulating the speed of rotation of the ball-engaging wheel through adjustment of control unit 42. For example, by varying the speed of rotation of the ball-engaging wheel through manipulation of motor control 42, the speed of rotation of the ball can be varied thereby governing the tendency of the ball to rise or fall within the strike zone. Also, when pitching, the speed can be changed together with the type of pitch to go from pitching very short distances to regulation distances. As previously mentioned, by loosening knob 70 barrel portion 30 can also be tilted upwardly to permit the machine to be used for throwing deep line drives and long fly balls.

In using the machine for batting practice, not only can the pitching head be adjusted upwardly and downwardly, but it can also be rotated about second axis 27 in order to throw a variety of curved balls and sliders. This is accomplished by loosening knob 66 so as to permit rotation of the pitching head through any part of an angle of 270 degrees in the manner illustrated in FIGS. 8, 11, and 12. By way of example, when wheel 36 is rotating in a clockwise direction and when the pitching head is rotated 90 degrees as shown in FIG. 11, a right-breaking horizontal curve will result.

Conversely, when the pitching head is fully rotated to the 270 degree position shown in FIG. 12, a left-breaking horizontal curve will result. The nature and extent of the curvature of the ball is, of course, controlled both by the angular position of the pitching head within the 270 degree arc and by the speed of rotation of the driving motor 40 as controlled by speed control unit 42. With this novel construction, the variety of pitches that can be thrown by the machine is virtually limitless and the player can practice against pitches having a varying degree of curvature, speeds, rises and drops. Similarly, by appropriate side-to-side and upward and downward adjustment of the pitching head, the balls can be pitched and various locations both inside and outside the strike zone. Additionally, the pinch pad 34 can be easily changed so that the device can be used to pitch balls of various diameters, including, but not limited to, baseball size and softball size.

Figure 14:
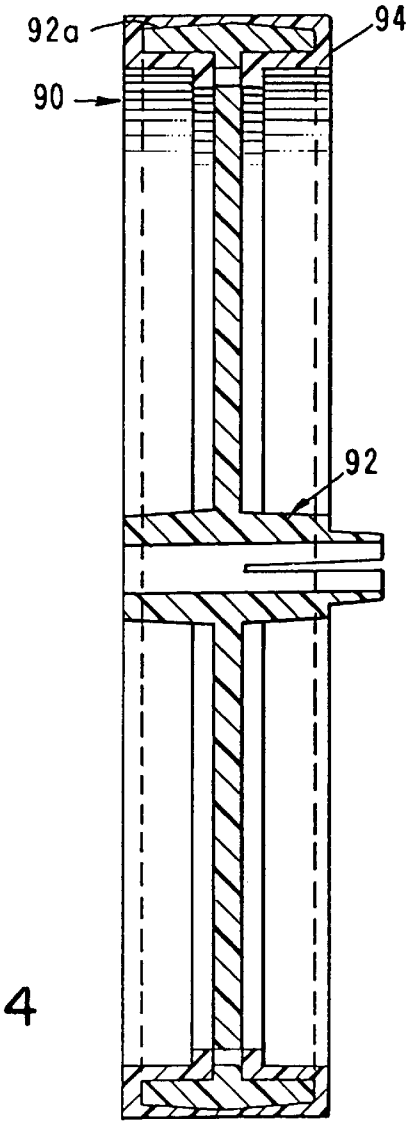
FIG. 14 is an enlarged, cross-sectional view taken along lines 14—14 of FIG. 13.
Figure 13:
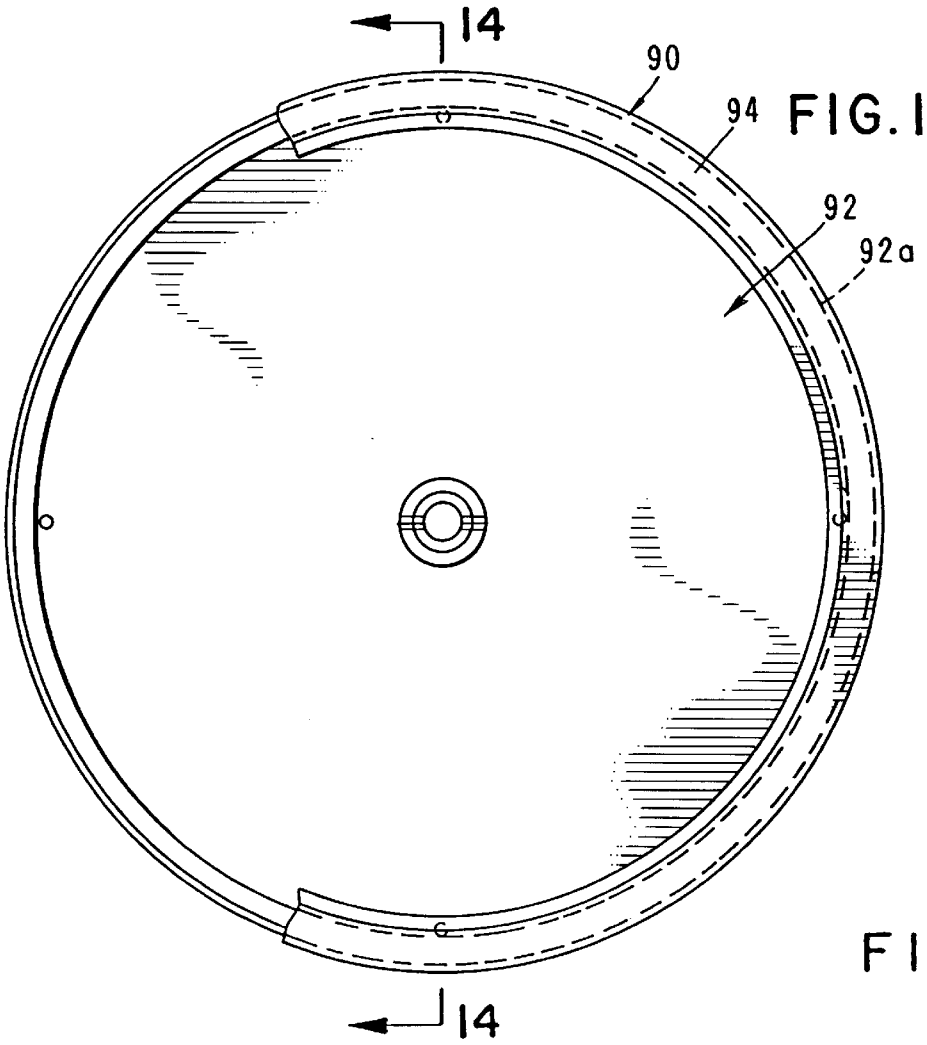
FIG. 13 is a side-elevational view of an alternate form of rotating ball propelling wheel partly broken away to show internal construction.

Turning to FIGS. 13 and 14, an alternate design of ball engaging wheel is there shown. This wheel, which is generally designated by the numeral 90, is of unique design and is manufactured by a novel process by which the hub 92 and tire 94 are co-molded. This process uses two different but compatible materials and chemically bonds them together. The hub material is preferably polypropylene, and the tire is preferably sanoprene. When compared to conventional prior art processes, the process is far more efficient, and provides a consistent high-quality wheel. More particularly, the prior art processes for making wheels that may be subjected to high speeds of rotation typically involve the steps of molding or casting the hub, machining the hub to finish dimensions, applying a suitable primer to the bonding surface, applying a suitable bonding agent to the bonding surface and finally applying the tire material to the hub.

Wheel 90 is rotatably mounted within housing assembly 25 in the same manner as is wheel 36. With wheel 90 thusly mounted, when the ball to be pitched is inserted into the upwardly curved end portion 30*a* of barrel 30 in the manner illustrated in FIG. 3, the ball will be urged inwardly of the barrel portion and then forwardly in a direction toward the ball engaging pinch pad 34. When the ball reaches the pinch pad 34, it will be pinched between the pinch pad and the resiliently deformable peripheral portion 94 of the ball engaging wheel 90 causing the ball to be propelled rapidly outwardly of the barrel portion 30.

In sharp contradistinction, one form of the process of the present invention for making the wheel comprises the steps of injecting into a preheated mold a polypropylene material to form the hub 92 which has a peripheral portion 92*a*. The tire 94 is then molded about the peripheral portion 92*a* of the hub to form the construction shown in FIGS. 13 and 14.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A ball pitching machine comprising:

(a) a base assembly;

(b) a pitching head assembly rotatably mounted on said base assembly for controlled rotation about a first axis, said pitching head assembly comprising:

(i) a support bracket;

(ii) a housing assembly pivotally connected to said support bracket for pivotal movement about a second axis between a first position and an arcuately spaced second position, said housing assembly comprising a barrel portion and a wheel housing portion;

(iii) a removable, ball-engaging pinch pad mounted within said barrel portion of said housing assembly;

(iv) a single ball-engaging wheel rotatably mounted within said wheel housing portion of said housing assembly, a portion of said ball-engaging wheel extending into said barrel portion of said housing assembly proximate said pinch pad, said single ball-engaging wheel comprising:

a. a yieldably deformable peripheral portion; and b. a plurality of radially extending curved vanes for causing a negative pressure to be generated within said barrel portion of said housing assembly as said wheel rotates;

Whereby when the ball to be pitched is inserted into said barrel portion it will be pinched between said peripheral portion of said ball engaging wheel and said pinch pad causing the ball to be propelled outwardly with a spinning rotation from said barrel portion as said ball engaging wheel rotates.

2. A machine as defined in claim 1 in which said pitching head assembly further includes electric motor means connected to said wheel housing portion for rotating said ball engaging wheel at various controlled speeds of rotation.

3. A machine as defined in claim 1 in which said support bracket comprises first and second components, said first component having first and second ends, said first end including a generally planar portion connected to said base portion.

4. A machine as defined in claim 3 in which said second component of said support bracket also has first and second ends, said first end being connected to said first component of said support bracket and said second end terminating in an arcuate shaped extremity circumscribing said second axis.

5. A machine as defined in claim 4 in which said first component of said support bracket is provided with an arcuate slot and in which said second component of said support bracket is provided with an aperture aligned with said arcuate slot.

6. A machine as defined in claim 5 further including locking means for locking together said first and second components of said support bracket, said locking means comprising:

(a) a bolt having a threaded shank simultaneously receivable within said arcuate slot and said aperture provided in said second component of said support bracket; and (b) a finger engaging knob threadably interconnected with said threaded shank for urging said first and second components into non-rotatable engagement.

7. A machine as defined in claim 6 in which said pitching head assembly further includes:

(a) an axle having a longitudinal axis coaxially aligned with said second axis; and (b) a hollow cylinder having a longitudinal axis also coaxially aligned with said second axis, said hollow cylinder having first and second apertured ends adapted to receive said axle and being rotatably received within said arcuate shaped extremity of said second component of said support bracket.

8. A machine as defined in claim 7 further including locking means for locking said hollow cylinder against rotation about said axle.

9. A machine as defined in claim 8 in which said housing assembly is pivotally movable about said second axis through an angle of approximately 270 degrees.

10. A ball pitching machine comprising a base assembly and a pitching head assembly rotatably mounted on said base assembly for controlled rotation about a first axis, said pitching head assembly comprising:

(a) a support bracket including first and second pivotally interconnected components, said first component being connected to said base and said second component terminating in an end portion;

(b) first locking means for locking said first and second components against pivotal movement;

(c) a housing assembly pivotally connected to said end portion of said second component of said support bracket for pivotal movement about a second axis between a first position and an arcuately spaced second position, said housing assembly comprising a barrel portion and a wheel housing portion;

(d) second locking means for locking said housing assembly against pivotal movement relative to said second component of said support bracket;

(e) a ball-engaging pinch pad removably mounted within said barrel portion of said housing assembly;

(f) single ball-engaging wheel rotatably mounted within said wheel housing portion of said housing assembly, a portion of said ball-engaging wheel extending into said barrel portion of said housing assembly proximate said pinch pad, said single ball-engaging wheel comprising:

(i) a yieldably deformable peripheral portion; and (ii) a plurality of radially extending curved vanes for causing a negative pressure to be generated within said barrel portion of said housing assembly as said wheel rotates; and (g) motor means mounted on said wheel housing portion of said housing assembly for controllably rotating said ball engaging wheel at various rates of speed.

11. a machine as defined in claim 10 in which said pitching head assembly further includes:

(a) an axle having a longitudinal axis coaxially aligned with said second axis; and (b) a hollow cylinder having a longitudinal axis also coaxially aligned with said second axis, said hollow cylinder having first and second apertured ends adapted to receive said axle and being rotatably received within said arcuate shaped extremity of said second component of said support bracket.

12. A ball pitching machine comprising:

(a) a base assembly;

(b) a pitching head assembly rotatably mounted on said base assembly for controlled rotation about a first axis, said pitching head assembly comprising:

(i) a support bracket;

(ii) a housing assembly pivotally connected to said support bracket for pivotal movement about a second axis between a first position and an arcuately spaced second position, said housing assembly comprising a barrel portion and a wheel housing portion;

(iii) a ball-engaging pinch pad mounted within said barrel portion of said housing assembly;

(iv) a single ball-engaging wheel rotatably mounted within said wheel housing portion of said housing assembly, a portion of said ball-engaging wheel extending into said barrel portion of said housing assembly proximate said pinch pad, said single ball-engaging wheel comprising:

a. a hub formed from a polypropylene material, said hub having a peripheral portion; and b. a resiliently deformable tire portion formed from a molded sanoprene surrounding said peripheral portion and being affixed thereto by chemical bonding, whereby, when the ball to be pitched is inserted into said barrel portion, it will be pinched between said peripheral portion of said ball engaging wheel and said pinch pad causing the ball to be propelled outwardly with a spinning rotation from said barrel portion as said ball engaging wheel rotates.

13. A ball pitching machine comprising:

(a) a base assembly;

(b) a pitching head assembly rotatably mounted on said base assembly for rotation about a first axis, said pitching head assembly comprising:

(i) a support bracket having first and second ends said first end being connected to said base assembly and said second end terminating at a location proximate a second axis;

(ii) a housing assembly pivotally connected to said support bracket for pivotal movement about a second axis between a first position and an arcuately spaced second position, said housing assembly comprising a barrel portion and a wheel housing portion;

(iii) a stationary ball engaging pinch pad mounted within said barrel portion of said housing assembly; and (iv) a single ball engaging wheel rotatably mounted within said wheel housing portion of said housing assembly, a portion of said ball engaging wheel extending into said barrel portion of said housing assembly proximate said pinch pad whereby, when the ball to be pitched is inserted into said barrel portion, it will be pinched between said ball engaging wheel and said pinch pad and will be propelled outwardly from said barrel position, said single ball-engaging wheel including an outer peripheral portion and having a plurality of radially extending curved vanes for causing a negative pressure to be generated within said barrel portion of said housing assembly as said wheel rotates, whereby the ball to be pitched, when inserted into said barrel portion, will be urged inwardly of this barrel portion in a direction toward said ball engaging pinch pad for pinching engagement between said peripheral portion of said ball-engaging wheel and said ball-engaging pinch pad.

14. A ball pitching machine comprising:

(a) a base assembly;

(b) a pitching head assembly rotatably mounted on said base assembly for rotation about a first axis, said pitching head assembly comprising:

(i) a support bracket having first and second ends, said first end being connected to said base assembly and said second end terminating at a location proximate a second axis, said support bracket comprising first and second pivotally interconnected components which are connected together for relative pivotal movement about a third axis, whereby said barrel portion of said housing assembly can be adjusted upwardly and downwardly to vary the trajectory of the ball being pitched;

(ii) a housing assembly pivotally connected to said support bracket for pivotal movement about said second axis between a first position and an arcuately spaced second position, said housing assembly comprising a barrel portion and a wheel housing portion;

(iii) a stationary ball engaging pinch pad mounted within said barrel portion of said housing assembly; and (iv) a single ball engaging wheel rotatably mounted within said wheel housing portion of said housing assembly, a portion of said ball engaging wheel extending into said barrel portion of said housing assembly proximate said pinch pad whereby, when the ball to be pitched is inserted into said barrel portion, it will be pinched between said ball engaging wheel and said pinch pad and will be propelled outwardly from said barrel position.

15. A ball pitching machine comprising:

(a) a base assembly;

(b) a pitching head assembly rotatably mounted on said base assembly for rotation about a first axis, said pitching head assembly comprising:

(i) a support bracket having first and second ends, said first end being connected to said base assembly and said second end being generally "C" shaped in cross section and terminating at a location proximate a second axis;

(ii) a housing assembly pivotally connected to said support bracket for pivotal movement about said second axis between a first position and an arcuately spaced second position, said housing assembly comprising a barrel portion and a wheel housing portion;

(iii) a stationary ball engaging pinch pad mounted within said barrel portion of said housing assembly;

(iv) a single ball engaging wheel rotatably mounted within said wheel housing portion of said housing assembly, a portion of said ball engaging wheel extending into said barrel portion of said housing assembly proximate said pinch pad whereby, when the ball to be pitched is inserted into said barrel portion, it will be pinched between said ball engaging wheel and said pinch pad and will be propelled outwardly from said barrel position;

(v) an axle having a longitudinal axis coaxially aligned with said second axis, said pitching head assembly being rotatably supported by said axle; and (vi) a hollow cylinder having a longitudinal axis coaxially aligned with said second axis, said hollow cylinder having first and second apertured ends adapted to receive said axle in a manner to position said hollow cylinder within said second end of said support bracket.

16. A machine as defined in claim 15 further including first locking means for locking said hollow cylinder against rotation about said axle.

17. A machine as defined in claim 15 in which said support bracket includes first and second pivotally connected components and in which said machine further includes second locking means for locking said first and second components of said support bracket against pivotal movement.

18. A ball pitching machine comprising a base assembly and a pitching head assembly rotatably mounted on said base assembly for controlled rotation about a first axis, said pitching head assembly comprising:

(a) a support bracket including first and second pivotally interconnected components, said first component being connected to said base and said second component terminating in an end portion;

(b) first locking means for locking said first and second components against pivotal movement;

(c) a housing assembly pivotally connected to said end portion of said second component of said support bracket for pivotal movement about a second axis between a first position and an arcuately spaced second position, said housing assembly comprising a barrel portion and a wheel housing portion;

(d) second locking means for locking said housing assembly against pivotal movement relative to said second component of said support bracket;

(e) a ball-engaging pinch element removably mounted within said barrel portion of said housing assembly;

(f) single ball-engaging wheel having a yieldably deformable peripheral portion rotatably mounted within said wheel housing portion of said housing assembly, a portion of said ball-engaging wheel extending into said barrel portion of said housing assembly proximate said pinch element;

(g) an axle having a longitudinal axis coaxially aligned with said second axis; and (h) a hollow cylinder having a longitudinal axis also coaxially aligned with said second axis, said hollow cylinder having first and second apertured ends adapted to receive said axle and being rotatably received within said arcuate shaped extremity of said second component of said support bracket.

19. A ball pitching machine comprising a base assembly and a pitching head assembly rotatably mounted on said base assembly for controlled rotation about a first axis, said pitching head assembly comprising:

(a) a support bracket including first and second pivotally interconnected components, said first component being connected to said base and said second component terminating in an end portion;

(b) first locking means for locking said first and second components against pivotal movement;

(c) a housing assembly pivotally connected to said end portion of said second component of said support bracket for pivotal movement about a second axis between a first position and an arcuately spaced second position, said housing assembly comprising a barrel portion and a wheel housing portion;

(d) second locking means for locking said housing assembly against pivotal movement relative to said second component of said support bracket;

(e) a ball-engaging pinch element removably mounted within said barrel portion of said housing assembly;

(f) single ball-engaging wheel having a yieldably deformable peripheral portion rotatably mounted within said wheel housing portion of said housing assembly, a portion of said ball-engaging wheel extending into said barrel portion of said housing assembly proximate said pinch element, said single ball-engaging wheel comprising:

(i) a hub formed from a polypropyline material, said hub having a peripheral portion; and (ii) a resiliently deformable tire portion formed from a molded sanoprene surrounding said peripheral portion and being affixed thereto.

* * * * *